US010392732B2

(12) United States Patent
Lonati et al.

(10) Patent No.: US 10,392,732 B2
(45) Date of Patent: Aug. 27, 2019

(54) CIRCULAR MACHINE FOR KNITTING, HOSIERY OR THE LIKE, WITH SINKER ACTUATION DEVICE

(71) Applicant: Lonati S.P.A., Brescia (IT)

(72) Inventors: Ettore Lonati, Botticino (IT); Fausto Lonati, Brescia (IT); Francesco Lonati, San Felice del Benaco (IT)

(73) Assignee: LONATI S.P.A., Brescia (IT)

( * ) Notice: Subject to any disclaimer, the term of this patent is extended or adjusted under 35 U.S.C. 154(b) by 134 days.

(21) Appl. No.: 15/522,629

(22) PCT Filed: Oct. 26, 2015

(86) PCT No.: PCT/EP2015/074717
§ 371 (c)(1),
(2) Date: Apr. 27, 2017

(87) PCT Pub. No.: WO2016/066573
PCT Pub. Date: May 6, 2016

(65) Prior Publication Data

US 2017/0335496 A1 Nov. 23, 2017

(30) Foreign Application Priority Data

Oct. 29, 2014 (IT) ..... MI2014A1852

(51) Int. Cl.
*D04B 15/34* (2006.01)
*D04B 15/32* (2006.01)
(Continued)

(52) U.S. Cl.
CPC ..... *D04B 15/32* (2013.01); *D04B 9/20* (2013.01); *D04B 15/06* (2013.01); *D04B 15/34* (2013.01)

(58) Field of Classification Search
CPC ..... D04B 9/20; D04B 15/34
See application file for complete search history.

(56) References Cited

U.S. PATENT DOCUMENTS 999,853 A 8/1911 Paquette
2,116,358 A * 5/1938 Leedham ..... D04B 9/26 66/107

(Continued)

FOREIGN PATENT DOCUMENTS

CN 1742125 3/2006
CN 103946432 7/2014

(Continued)

OTHER PUBLICATIONS

Colombian Office Action No. 11089, Ref. No. NC2017/0005224.

(Continued)

*Primary Examiner* — Danny Worrell
(74) *Attorney, Agent, or Firm* — Husch Blackwell LLP

(57) ABSTRACT

A circular machine for knitting, hosiery or the like, with sinker actuation device, comprising a needle cylinder; the needle cylinder has, on its lateral surface, a plurality of axial grooves, each of which accommodates a needle that can move on command along the corresponding axial groove in order to pick up at least one yarn dispensed at at least one feed or drop and form knitting; the machine also comprises needle actuation cams, which face the lateral surface of the needle cylinder and define paths that are extended around the axis of the needle cylinder and can be engaged by at least one heel of the needles, which protrudes from the lateral surface of the needle cylinder, in order to actuate the movement of the needles along the corresponding axial groove with respect to the needle cylinder as a consequence of the rotation of the needle cylinder about its own axis with respect to the needle actuation cams and the at least one feed.

10 Claims, 10 Drawing Sheets

(51) Int. Cl.
*D04B 9/20* (2006.01)
*D04B 15/06* (2006.01)

(56) References Cited

U.S. PATENT DOCUMENTS

| | | | | |
|---|---|---|---|---|
| 3,783,345 | A | 1/1974 | Bianchi | |
| 3,783,645 | A | 1/1974 | Bianchi | |
| 4,314,461 | A * | 2/1982 | Conti | D04B 9/02 66/107 |
| 4,492,097 | A * | 1/1985 | Ferraris | D04B 15/34 66/108 R |
| 5,931,025 | A * | 8/1999 | Lonati | D04B 9/12 66/108 R |
| 7,065,988 | B2 * | 6/2006 | Lonati | D04B 15/327 66/78 |

FOREIGN PATENT DOCUMENTS

| | | |
|---|---|---|
| CO | 05116684 | 5/2007 |
| GB | 13092 | 8/1911 |
| GB | 504473 | 4/1939 |
| WO | WO 03/100147 | 12/2003 |

OTHER PUBLICATIONS

Search Report from International PCT/EP2015/074717.
Italian Search Report and Written Opinion from IT MI20141852.
First Office Action related to Japanese Application No. 201580059536.3, dated Jul. 2, 2018 (6 pgs.).
English Translation of First Office Action related to Japanese Application No. 201580059536.3, dated Jul. 2, 2018 (3 pgs.).
Search Report related to Japanese Application No. 201580059536.3, dated Jun. 23, 2018 2018 (2 pgs.).
English translation of Search Report related to Japanese Application No. 201580059536.3, dated Jun. 23, 2018 2018 (2 pgs.).
Columbian Office Action regarding related application NC2017/0005224, dated Mar. 11, 2019 (11 pgs.).
Mexican Office Action regarding related application MX/a/2017/005696, dated Mar. 11, 2019.

* cited by examiner

CIRCULAR MACHINE FOR KNITTING, HOSIERY OR THE LIKE, WITH SINKER ACTUATION DEVICE

The present invention relates to a circular machine for knitting, hosiery or the like, with sinker actuation device.

As is known, circular machines for knitting or hosiery comprise a needle cylinder with a vertical axis, on the lateral surface of which there is a plurality of axial grooves, each of which accommodates, so that it can slide parallel to the axis of the needle cylinder, a corresponding needle. The needles can be actuated with a reciprocating motion along the corresponding axial groove so as to pick up at least one yarn dispensed at a feed or drop of the machine and form loops of knitting. The yarns to be used to manufacture the knitting are dispensed by adapted yarn fingers arranged at the so-called feeds or drops of the machine. Such yarn fingers are usually movable on command in order to place their yarn dispensing end in a position that is suitable to allow the needles to pick up the yarn or to a position that prevents the needles from picking up the yarn.

The needles are provided with heels that protrude from the lateral surface of the needle cylinder and engage paths defined by needle actuation cams that face the lateral surface of the needle cylinder. Such paths have rising portions and descending portions so that the heels of the needles, following the paths as a consequence of the rotation of the needle cylinder about its own axis with respect to the needle actuation cams, are pushed so as to protrude with their head or tip upwardly from the needle cylinder in order to pick up at least one yarn that is dispensed at a feed or drop and then descend to form new loops of knitting with the yarn that they have picked up.

Such machines are usually provided with sinkers that are arranged within radial grooves of an adapted support, known as "sinker ring", which is associated integrally with the needle cylinder at its upper end.

The sinkers are offset with respect to the needles so that each sinker lies between two contiguous needles and are actuated, during the rotation of the needle cylinder about its own axis, with a reciprocating motion along a radial direction with respect to the needle cylinder.

More particularly, the sinkers are moved away from the axis of the needle cylinder when the needles, after picking up the yarn at a feed or drop, begin their descent in order to form new loops of knitting, so that the region of the yarn or yarns comprised between two contiguous loops of knitting rests on the upper portion or "nose" of the sinkers, which is usually flat and is known as "knockover plane", while the previously formed loops are knocked over, i.e., abandoned by the corresponding needle or retained within the head or tip of the needle together with the new formed loops of knitting, depending on the type of knitting to be provided.

During the subsequent rise of the needles to pick up at least one other yarn to form new loops of knitting, the sinkers are moved toward the axis of the needle cylinder so as to engage the old loops of knitting by means of a hook that lies above the knockover plane, so as to obtain a tensioning of the loops of knitting against the shank of the needles. This tensioning against the shank of the needles also obtains the effect of causing assuredly the opening of the latch of the needles.

The movement of the sinkers along a radial direction with respect to the needle cylinder is obtained by means of corresponding actuation cams that are supported by a sinker cap, which has an annular shape and is arranged above and coaxially with respect to the sinker ring.

The sinker actuation cams define at least one path that is extended around the axis of the needle cylinder, with portions that progressively approach the axis of the needle cylinder and portions that are spaced progressively further away from the axis of the needle cylinder. Heels of the sinkers that protrude upwardly from the sinker ring engage in these paths. Substantially, when the needle cylinder is actuated with a rotary motion about its own axis with respect to the sinker cap, the sinkers, by following the paths defined by the corresponding actuation cams supported by the sinker cap, are moved alternatively toward and away from the axis of the needle cylinder in a manner that is coordinated with the reciprocating motion of the needles along the axial grooves of the needle cylinder so as to cooperate with them in forming the knitting, as described above.

During some types of knitting, such as for example during the formation of the toe and heel of hosiery, the needle cylinder is actuated with an alternating rotary motion about its own axis and only some of the needles arranged in the needle cylinder are moved to knit at a feed or drop of the machine.

For these types of knitting, two pusher cams, respectively a first pusher cam and a second pusher cam, are provided in the sinker cap and are arranged on mutually opposite sides with respect to an imaginary plane that passes through the axis of the needle cylinder and through the feed or drop that is used. The function of the pusher cams is to move the sinkers, located between the needles that picked up the yarn or yarns at the feed being considered and formed new loops of knitting, toward the axis of the needle cylinder, during the rotary motion in one direction of the needle cylinder, when the needles begin a new upward motion in preparation for pickup of the yarn at the feed being considered, which will be performed during the rotary motion of the needle cylinder in the opposite direction.

In machines of the known type, the pusher cams are fixed and apply equally a pushing action both on the sinkers located between the needles that are knitting and on the sinkers located between the needles that are excluded from knitting, i.e., are not moved to knit at the feed being considered.

In many cases, the needles that are excluded from knitting are kept with their head or tip between the sinkers below the knockover plane, tensioning the loops of knitting formed previously and retained within their head. In this case, the pushing action on the sinkers has the effect of increasing further the tension of the loops of knitting formed previously, which rest on the knockover plane of the sinkers.

This further tensioning of the loops of knitting in many cases can damage the knitting being formed, producing defects in the finished product.

This unwanted tension on the loops of knitting also occurs if the needles that are not moved to knit at the feed being considered are kept raised above the sinkers with the previously formed loops of knitting arranged on the needle shank.

In order to solve this problem, in some cases pusher cams are used which can move individually in a radial direction with respect to the axis of the needle cylinder by means of pneumatic actuators mounted on the sinker cap. Such actuators, in addition to increasing the complexity of the provision and installation of the sinker cap, suffer the drawback of low reliability, since the operation of the actuators is conditioned heavily by the temperature and by other external factors.

The aim of the present invention is to solve the problem described above, by providing a circular machine for knitting, hosiery or the like with a sinker actuation device that allows to limit the degree of tension applied by the sinkers to the loops of knitting formed previously and arranged on the needles that are excluded from knitting at the feed being used and is highly reliable in operation.

Within this aim, an object of the invention is to solve the problem described above, without increasing excessively the complexity of the sinker cap and of the elements intended for its actuation.

Another object of the invention is to provide a machine with a sinker actuation device that ensures high precision and repetitiveness of operation.

A further object of the invention is to provide a machine with a sinker actuation device that can be manufactured at competitive costs.

This aim, as well as these and other objects that will become better apparent hereinafter, are achieved by a circular machine for knitting, hosiery or the like, with sinker actuation device, comprising:

a needle cylinder, arranged so that its axis is substantially vertical and actuatable with a rotary motion about said axis in both directions of rotation; said needle cylinder having, on its lateral surface, a plurality of axial grooves, each of which accommodates a needle that can move on command along the corresponding axial groove in order to pick up at least one yarn dispensed at at least one feed or drop and form knitting;

needle actuation cams, which face the lateral surface of the needle cylinder and define paths that are extended around the axis of the needle cylinder and can be engaged by at least one heel of the needles, which protrudes from the lateral surface of the needle cylinder, in order to actuate the movement of the needles along the corresponding axial groove with respect to the needle cylinder as a consequence of the rotation of the needle cylinder about its own axis with respect to said needle actuation cams and said at least one feed;

a sinker ring, which is integral with said needle cylinder in rotation about its own axis and is arranged coaxially to the needle cylinder at its upper end, said sinker ring supporting a plurality of sinkers that can move radially with respect to the needle cylinder and to the sinker ring;

a sinker cap, which is arranged above and coaxially with respect to said sinker ring and supports sinker actuation cams that define at least one path that is extended around the axis of the needle cylinder and can be engaged by a heel of the sinkers, which protrudes upwardly from said sinker ring, in order to actuate the movement of the sinkers along a radial direction with respect to the needle cylinder and to said sinker ring as a consequence of the rotation of the needle cylinder about its own axis with respect to said sinker cap, to said at least one feed and to said sinker actuation cams;

said needle actuation cams comprising two needle lifting cams, respectively a first cam for lifting the needles to the tuck or dropped position and a second cam for lifting the needles to the tuck or dropped position, which are arranged on mutually opposite sides with respect to an imaginary plane that passes through the axis of the needle cylinder and through said at least one feed or drop of the machine;

said sinker actuation cams comprising two pusher cams, respectively a first pusher cam and a second pusher cam, arranged on mutually opposite sides with respect to an imaginary plane that passes through the axis of the needle cylinder and through said at least one feed or drop of the machine; said pusher cams being able to engage said heel of the sinkers to cause the movement of said sinkers toward the axis of the needle cylinder;

characterized in that said first pusher cam and said second pusher cam are arranged respectively at said first cam for lifting the needles to the tuck or dropped position and at said second cam for lifting the needles to the tuck or dropped position and can move with respect to said sinker cap toward or away from the axis of the needle cylinder, actuation means being provided which act on said first pusher cam and on said second pusher cam in order to move alternatively said first pusher cam or said second pusher cam toward the axis of the needle cylinder or away from the axis of the needle cylinder.

Further characteristics and advantages of the invention will become better apparent from the description of a preferred but not exclusive embodiment of the machine according to the invention, illustrated by way of nonlimiting example in the accompanying drawings, wherein.

Figure 1:
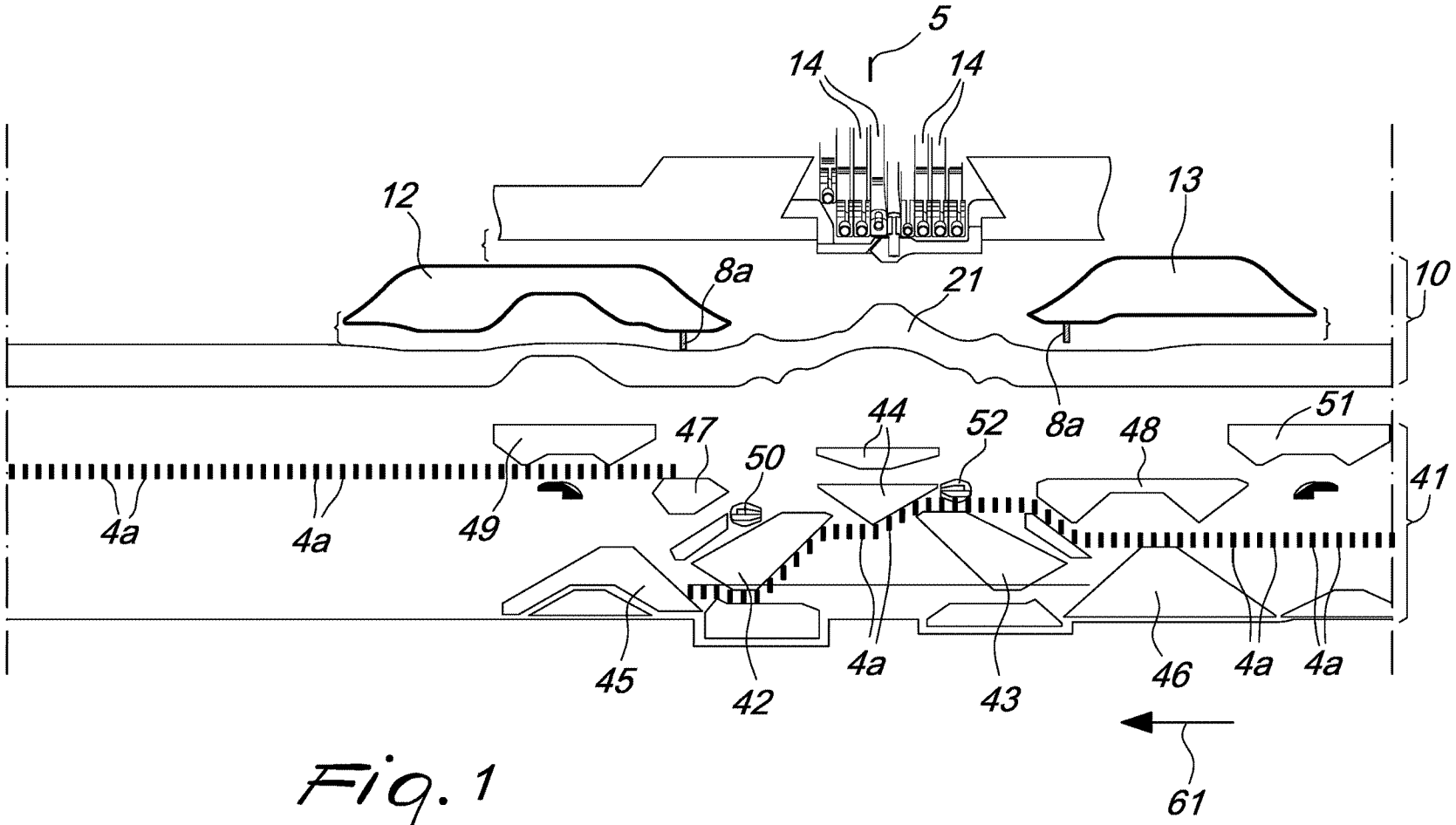
FIGS. 1 to 4 are schematic views of the needle actuation cams, extended flat, and of the sinker actuation cams, inverted through 90° above the needle actuation cams and extended along a rectilinear band, in different steps of operation of the machine.

With reference to the figures, the machine according to the invention, which is shown only schematically and partially for the sake of simplicity, is generally designated by the reference numeral 1.

The machine comprises, in per se known manner, a needle cylinder 2, which is arranged so that its axis 2*a* is substantially vertical and can be actuated with a rotary motion about the axis 2*a* in both directions of rotation. On the lateral surface of the needle cylinder 2 there are multiple axial grooves 3, each of which accommodates a corresponding needle 4, which is provided with at least one heel 4*a* that protrudes from the lateral surface of the needle cylinder 2 and can engage paths that are defined by needle actuation cams 41, which are of a known type and are shown only partially in FIGS. 1 to 4, arranged around the needle cylinder 2 and facing the lateral surface the needle cylinder 2, which can be actuated with a rotary motion about its own axis 2*a* with respect to the cams, so that the needles 4, by following these paths with their heel 4*a*, are actuated with an alternating motion along the corresponding axial groove 3 in order to pick up the yarn or yarns dispensed at at least one feed or drop 5 of the machine and form knitting.

At the upper end of the needle cylinder 2 there is a sinker ring 6 which is arranged coaxially to the needle cylinder 2 and is integral therewith in rotation about its own axis 2*a*.

The sinker ring 6 is composed of an external part 6*a*, arranged around the needle cylinder 2 at its upper end, and an internal part 6*b*, which is fixed to the internal side of the upper end of the needle cylinder 2. In the sinker ring 6 there are multiple grooves 7 that are oriented radially with respect to the needle cylinder 2 and are offset with respect to the axial grooves 3 of the needle cylinder 2, so that each radial groove 7 of the sinker ring 6 lies between two contiguous axial grooves 3 of the needle cylinder 2. Each one of the radial grooves 7 accommodates a corresponding sinker 8, which can move along the corresponding radial groove 7 toward and away with respect to the axis 2*a* of the needle cylinder 2.

Above the sinker ring 6 there is a sinker cap 9, which has an annular shape and is arranged coaxially to the sinker ring 6 and therefore coaxially to the needle cylinder 2 and supports sinker actuation cams 10. The sinker actuation cams 10 define at least one path that is extended around the axis 2*a* of the needle cylinder 2 and can be engaged by a heel 8*a* of the sinkers 8 that protrudes upwardly from the sinker ring 6. The path defined by the sinker actuation cams 10 is shaped so as to produce, as a consequence of the rotation of the sinker ring 6 integrally with the needle cylinder 2 with respect to the sinker cap 9, to the sinker actuation cams 10 and to the feed or drop 5, the alternating movement of the sinkers 8 toward and away from the axis 2*a* of the needle cylinder 2 in order to cooperate with the needles 4 in forming the knitting.

In the illustrated embodiment, below each sinker 8 there is a sub-sinker 11, which rests on the bottom of the corresponding radial groove 7. The sub-sinker 11, of a known type, is used to perform, together with other elements that are of a known type and are not shown for the sake of simplicity, a selection of the sinkers 8. It should be noted that the sub-sinker 11 can also be absent. In this case the sinkers 8 rest directly on the bottom of the corresponding radial groove 7.

In the machine according to the invention, the sinker actuation cams 10 comprise two pusher cams, respectively a first pusher cam 12 and a second pusher cam 13, which are arranged on mutually opposite sides with respect to an imaginary plane that passes through the axis 2*a* of the needle cylinder 2 and through a feed or drop 5 of the machine.

The pusher cams 12, 13 can engage the heel 8*a* of the sinkers 8 in order to produce the movement of the sinkers 8 toward the axis 2*a* of the needle cylinder 2.

In FIGS. 1 to 4, the feed or drop 5 is identified by a thicker line. At the feed 5 there are one or more yarn fingers 14, which can be actuated in a per se known manner in order to supply the needles 4 moved to knit at the feed 5 one or more yarns to form knitting.

According to the invention, the first pusher cam 12 and the second pusher cam 13 can move with respect to the sinker cap 9 toward or away from the axis 2*a* of the needle cylinder 2. The machine according to the invention comprises actuation means 15, which act on the first pusher cam 12 and on the second pusher cam 13 in order to move alternatively the first pusher cam 12 or the second pusher cam 13 toward the axis 2*a* of the needle cylinder 2 or away from the axis 2*a* of the needle cylinder 2.

The term "alternatively" is understood to mean that the movement toward the axis 2*a* of the needle cylinder 2 affects only the first pusher cam 12 or the second pusher cam 13. Likewise, the movement away from the axis 2*a* of the needle cylinder 2 affects only the first pusher cam 12 or the second pusher cam 13, as will become better apparent hereinafter.

Conveniently, the first pusher cam 12 and the second pusher cam 13 can move on command with respect to the sinker cap 9 from an inactive position, in which they are arranged at a preset distance from the axis 2*a* of the needle cylinder, to a pusher position, in which they are arranged at a shorter distance from the axis 2*a* of the needle cylinder 2 with respect to the inactive position.

More particularly, the sinker cap 9 comprises an annular cam supporting plate 16 that supports the first pusher cam 12 and the second pusher cam 13 slidingly along a direction that has a radial component with respect to the axis 2*a* of the needle cylinder 2. The actuation means 15 comprise an actuation element 17, which acts alternatively on the first pusher cam 12 and on the second pusher cam 13 in order to produce their movement from the inactive position to the pusher position or vice versa.

The pusher cams 12, 13 are arranged below the annular cam supporting plate 16 and are fixed to pins 20 that pass through radial slots 18 defined in the annular cam supporting plate 16. The radial slots 18 are elongated along directions that have a radial component with respect to the axis 2*a* of the needle cylinder 2 so as to allow the movement of the corresponding pusher cam 12 or 13 along a radial direction with respect to the needle cylinder 2. The actuation element 17 is arranged above the annular cam supporting plate 16 and is extended around the axis 2*a* of the needle center 2. The actuation element 17 has contoured slots 19, which are provided with at least one first portion 19*a* that is extended substantially concentrically to the axis 2*a* of the needle cylinder 2 and with at least one second portion 19*b* that is extended progressively toward the axis 2*a* of the needle cylinder 2 starting from the first portion 19*a*. The contoured slots 19 are each engaged by one of the pins 20 that are integral with the pusher cams 12, 13 and the actuation element 17 can rotate on command with respect to the annular cam supporting plate 16 about the axis 2*a* of the needle cylinder 2 from a first position, in which the pins 20 of the first pusher cam 12 are arranged along the first portion 19*a* of the contoured slots 19 while the pins 20 of the second pusher cam 13 are arranged along the second portion 19*b* of the contoured slots 19, to a second position, in which the pins 20 of the first pusher cam 12 are arranged along the second portion 19*b* of the contoured slots 19, while the pins 20 of the second pusher cam 13 are arranged along the first portion 19*a* of the contoured slots 19.

In this manner, when a pusher cam 12 or 13 is in the pusher position, the other pusher cam 13 or 12 is in the inactive position.

Conveniently, the actuation element 17 can be arranged in an intermediate position, between the first position and the second position, in which the pins 20 of the pusher cams 12, 13 are arranged in the passage region between the first portion 19*a* and the second portion 19*b* of the contoured slots 19. In this manner, with the actuation element 17 in this intermediate position, it is possible to have both pusher cams 12, 13 in the inactive position.

In the illustrated embodiment, each pusher cam 12, 13 is fixed to two pins 20, each of which engages a corresponding contoured slot 19. There are therefore two contoured slots 19 for each pusher cam 12, 13, but the number of contoured slots 19 for each pusher cam 12, 13 can vary according to the requirements.

In addition to the pusher cams 12, 13, other sinker actuation cams of a known type are fixed below the annular cam supporting plate 16 and are not described in detail for the sake of simplicity. The drawings show only some of the sinker actuation cams, which have been generally designated by the reference numeral 21.

The actuation element 17, which is substantially plate-like, has a contoured annular shape that is extended around the axis 2*a* of the needle cylinder 2. The actuation element 17 is supported, so that it can rotate about the axis 2*a* of the needle cylinder 2, by the annular cam supporting plate 16.

The actuation means 15 comprise a first electric motor 22, preferably a step motor, which is connected kinematically with its output shaft to a toothed arch 23, which is concentric to the axis 2*a* of the needle cylinder 2 and is defined in a peripheral region of the actuation element 17. The first electric motor 22 can be actuated to produce the rotation of the actuation element 17 about the axis 2*a* of the needle cylinder 2 with respect to the annular cam supporting plate 16 from the first cited position to the second cited position or to the intermediate position and vice versa, as will become better apparent hereinafter.

More particularly, the first electric motor 22 is fixed by means of its body to the annular cam supporting plate 16. A toothed pulley 24 is keyed on its output shaft and is connected, by means of a toothed belt 25, to another toothed pulley 26, which is keyed on a transmission shaft 27. A gear 28 is keyed on the transmission shaft 27 and meshes with an intermediate gear 29, which in turn mates with the toothed arch 23 of the actuation element 17. The output shaft of the first electric motor 22 and the transmission shaft 27, as well as the intermediate gear 29, are arranged so that their axes are parallel to the axis 2*a* of the needle cylinder 2.

The intermediate gear 29 is supported, so that it can rotate about its own axis, by a centering wheel 30, which is fixed, by means of screws 31, to the upper face of the annular cam supporting plate 16.

The extent of the rotation of the actuation element 17 about the axis 2*a* of the needle cylinder with respect to the annular cam supporting plate 16 can be visualized by providing a graduated sector 32 on the actuation element 17 and a locator 33 on a portion of the annular cam supporting plate 16 or on an element that is integral therewith.

As in sinker caps of the known type, the annular cam supporting plate 16, instead of being fixed to the supporting structure of the machine, might be supported, so that it can rotate about the axis 2*a* of the needle cylinder 2, by a supporting element 34, which is integral with the supporting structure of the machine. In this case, the annular cam supporting plate 16 can be rotated on command about the axis 2*a* of the needle cylinder 2 with respect to the supporting element 34, by means of the actuation of a second electric motor 35, for example a step motor, through angles of preset breadth in order to anticipate or delay the intervention of the sinker actuation cams 10 on the heels 8*a* of the sinkers 8.

As shown, the second electric motor 35 can be associated by means of its body with the annular cam supporting plate 16 and can be connected kinematically, by way of its output shaft, to a toothed arch 36, which is concentric to the axis 2*a* of the needle cylinder 2, defined in a peripheral region of the supporting element 34.

More particularly, a gear 37 is keyed on the output shaft of the second electric motor 35 and mates with the toothed arch 36. In this manner, the actuation of the second electric motor 35 produces the rotation of the annular cam supporting plate 16 and of the second electric motor 35 about the axis 2*a* of the needle cylinder 2 with respect to the supporting element 34.

For the sake of completeness in description, it should be noted that the centering wheel 30 is covered partially by a protective cover 38 and the contoured slots 19 also are covered by protective plates 39 that are arranged above the actuation element 17 and are retained by the pins 20, provided as screws.

FIGS. 1 to 4 show schematically the flat extension of the needle actuation cams 41 and of the sinker actuation cams 10 proximate to a feed or drop 5 of the machine that is used to form knitting when the needle cylinder 2 is actuated with an alternating rotary motion about its own axis 2*a*.

Figure 2:
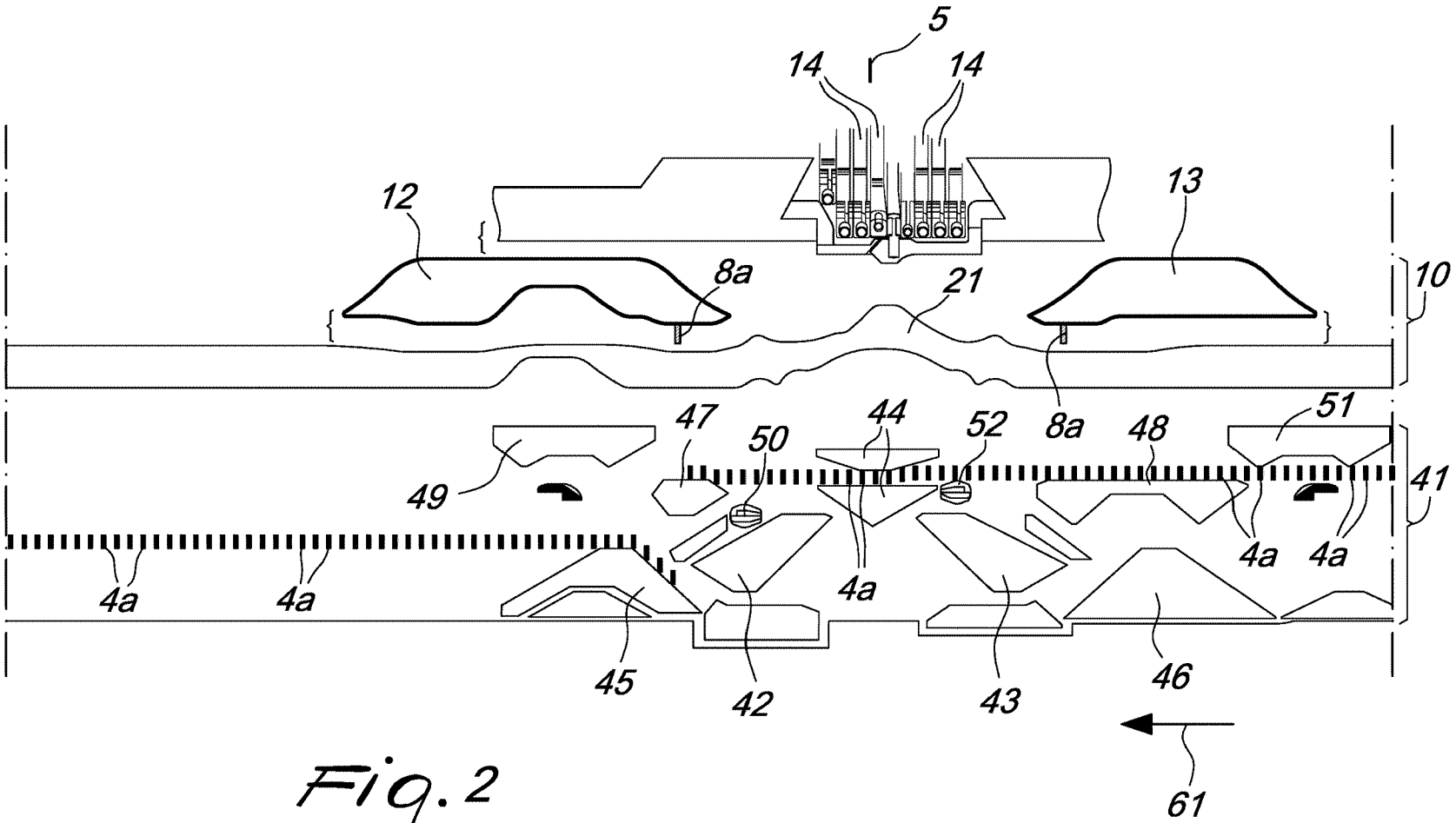
Figure 3:
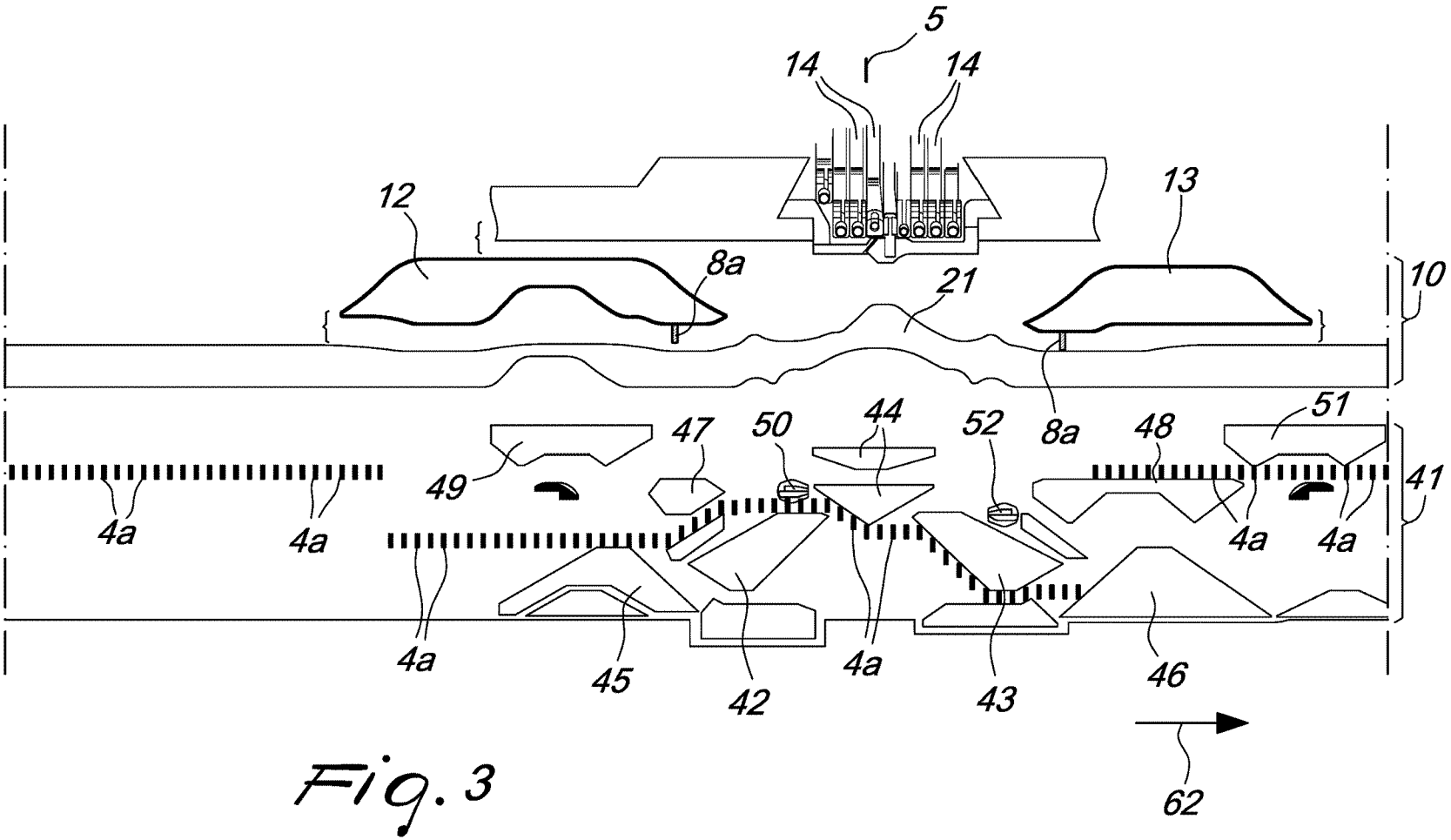
Figure 4:
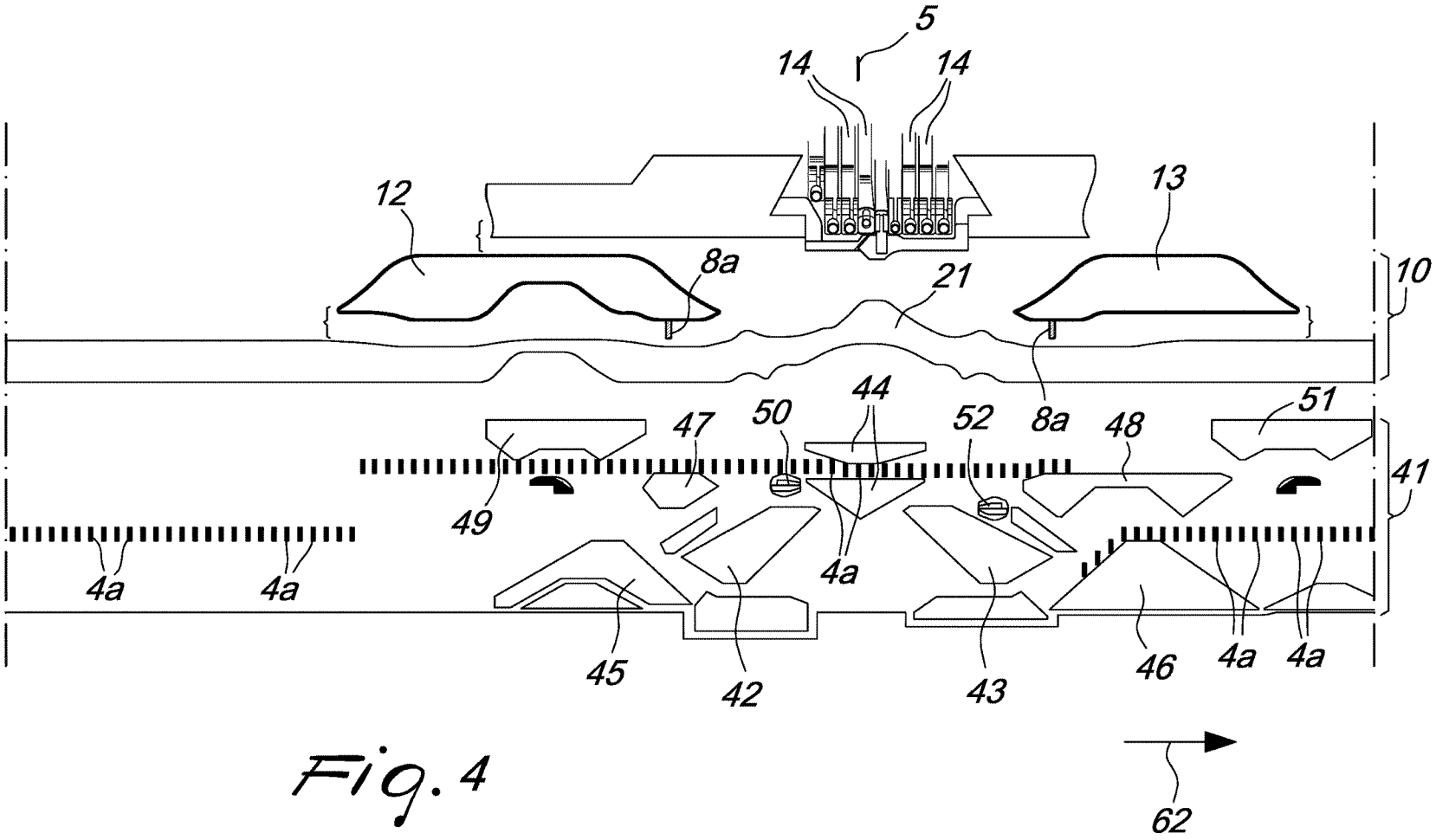

In these figures, as regards the needle actuation cams 41, the following are shown: a knitting forming cam or knockover cam 42 for the rotary motion of the needle cylinder 2 in the direction of rotation indicated by the arrow 61 in FIGS. 1 and 2 and a knitting forming cam or knockover cam 43 for the rotary motion of the needle cylinder 2 in the direction of rotation indicated by the arrow 62 in FIGS. 3 and 4. A central cam 44 is arranged between the knitting forming cams 42, 43. Two needle lifting cams 45, 46 are also shown, respectively a first cam for lifting the needles to the tuck or dropped position 45 for the rotary motion of the needle cylinder 2 in the direction of rotation indicated by the arrow 61 in FIGS. 1 and 2 and a second cam for lifting the needles to the tuck or dropped position 46 for the rotary motion of the needle cylinder 2 in the direction of rotation indicated by the arrow 62 in FIGS. 3 and 4.

The first cam for lifting the needles to the tuck or dropped position 45 and the second cam for lifting the needles to the tuck or dropped position 46 are located on mutually opposite sides with respect to an imaginary plane that passes through the axis 2*a* of the needle cylinder 2 and through the at least one feed or drop 5 of the machine.

The expression "tuck position" is understood to reference a position in which the needle 4 is raised to such a level that the loop of knitting formed previously opens the latch of the needle 4 without passing, below it, onto the shank of the needle 4. Should the needle 4 pick up a yarn in this position and form a new loop of knitting, the new loop of knitting would be located in the head of the needle 4 together with the previously formed loop of knitting, providing a stitch known as "tuck stitch".

The expression "dropped position" is understood to reference a position in which the needle 4 is raised to such a level that the previously formed loop of knitting opens the latch of the needle 4, passing below it onto the shank of the needle 4. Should the needle 4 pick up a yarn in this position and form a new loop of knitting, the new loop of knitting would be knitted in with the previous loop of knitting, which would be dropped by the needle 4.

Each one of the cams for lifting the needles to the tuck or dropped position 45, 46 has, at its top, a cam portion 45*a*, 46*a* that can move on command, in a per se known manner, along a radial direction with respect to the needle cylinder 2 in order to pass from an active position, in which it is close to the needle cylinder 2 in order to interfere with the heel 4*a* of the needles 4, to an inactive position, in which it is spaced from the needle cylinder 2 so as to not interfere with the heel 4*a* of the needles 4. If the cam portion 45*a* or 46*a* is in the active position, shown in FIGS. 1 to 4, the needles 4 that engage with their heel 4*a* the lifting cams 45, 46 are raised into the dropped position, while if the cam portion 45*a* or 46*a* is in the inactive position, the needles 4 that engage with their heel 4*a* the lifting cams 45, 46 are raised to the tuck position.

In FIGS. 2 and 4, some heels 4*a* of the needles 4 raised to the tuck position when the portions 45*a* and 46*a* of the lifting cams 45 and 46 are in the inactive position have been shown in dashed lines.

As can be seen in FIGS. 1 to 4, the first pusher cam 12 is arranged substantially at the first cam for lifting the needles to the tuck or dropped position 45, while the second pusher cam 13 is arranged substantially at the second cam for lifting the needles to the tuck or dropped position 46.

The term "at", with reference to the first pusher cam 12 and to the first cam for lifting the needles to the tuck or dropped position 45, is understood to mean that these cams, though being arranged respectively in the sinker cap 9 and around the needle cylinder 2, are arranged substantially in the same angular position around the axis 2*a* of the needle cylinder 2 so that when a needle 4 engages by means of its heel 4*a* the first cam for lifting the needles to the tuck or dropped position 45, the sinkers 8 that are contiguous to the needle 4 engage the first pusher cam 12 by means of their heel 8*a*.

The same applies for the term "at" with reference to the second pusher cam 13 and to the second cam for lifting the needles to the tuck or dropped position 46.

The cams 47, 48 are cams for leveling the needles 4 that are inactive, i.e., are not moved to knit at the feed 5 being considered, respectively for the rotary motion of the needle cylinder 2 in the direction of rotation indicated by the arrow 61 in FIGS. 1 and 2 and for the rotary motion of the needle cylinder 2 in the direction of rotation indicated by the arrow 62 in FIGS. 3 and 4.

A needle lowering picker 49 and a needle lifting picker 50 for the rotary motion of the needle cylinder 2 in the direction of rotation indicated by the arrow 62 in FIGS. 3 and 4, a needle lowering picker 51 and a needle lifting picker 52 for the rotary motion of the needle cylinder 2 in the direction of rotation indicated by the arrow 61 in FIGS. 1 and 2 are also illustrated.

FIGS. 1 to 4, for the sake of simplicity and greater clarity, show only the heels 8*a* of two sinkers 8 that engage respectively the first pusher cam 12 and the second pusher cam 13.

Operation of the machine according to the invention, in knitting in which the needle cylinder 2 is actuated with an alternating rotary motion about its own axis 2*a*, using only part of the needles 4, such as for example during the formation of the toe or heel of a hosiery item in a circular hosiery knitting machine, is as follows.

Figure 5:
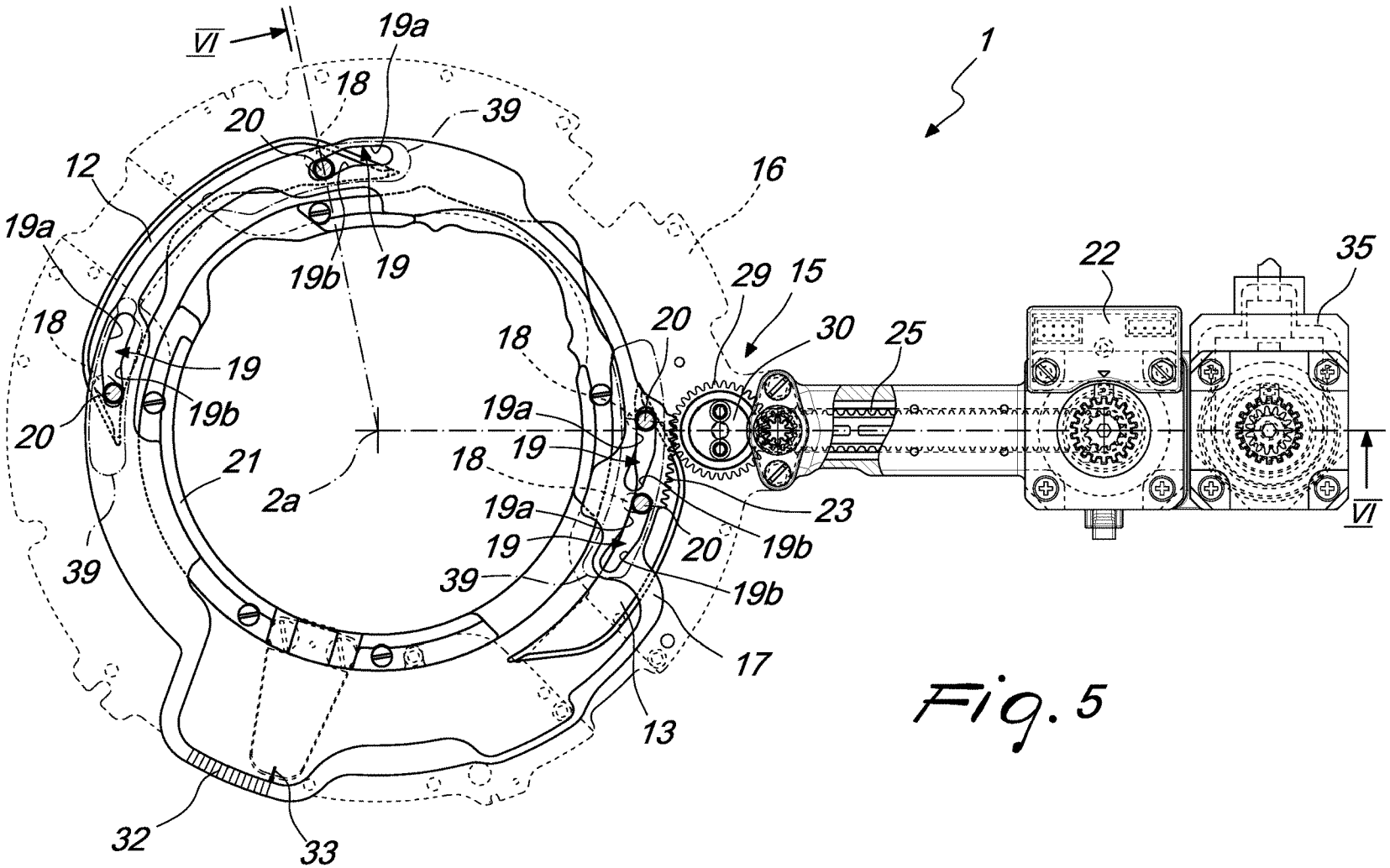
FIG. 5 is a schematic top plan view of a part of the sinker cap, with some elements shown in phantom lines, during a step of the operation of the machine.
Figure 6:
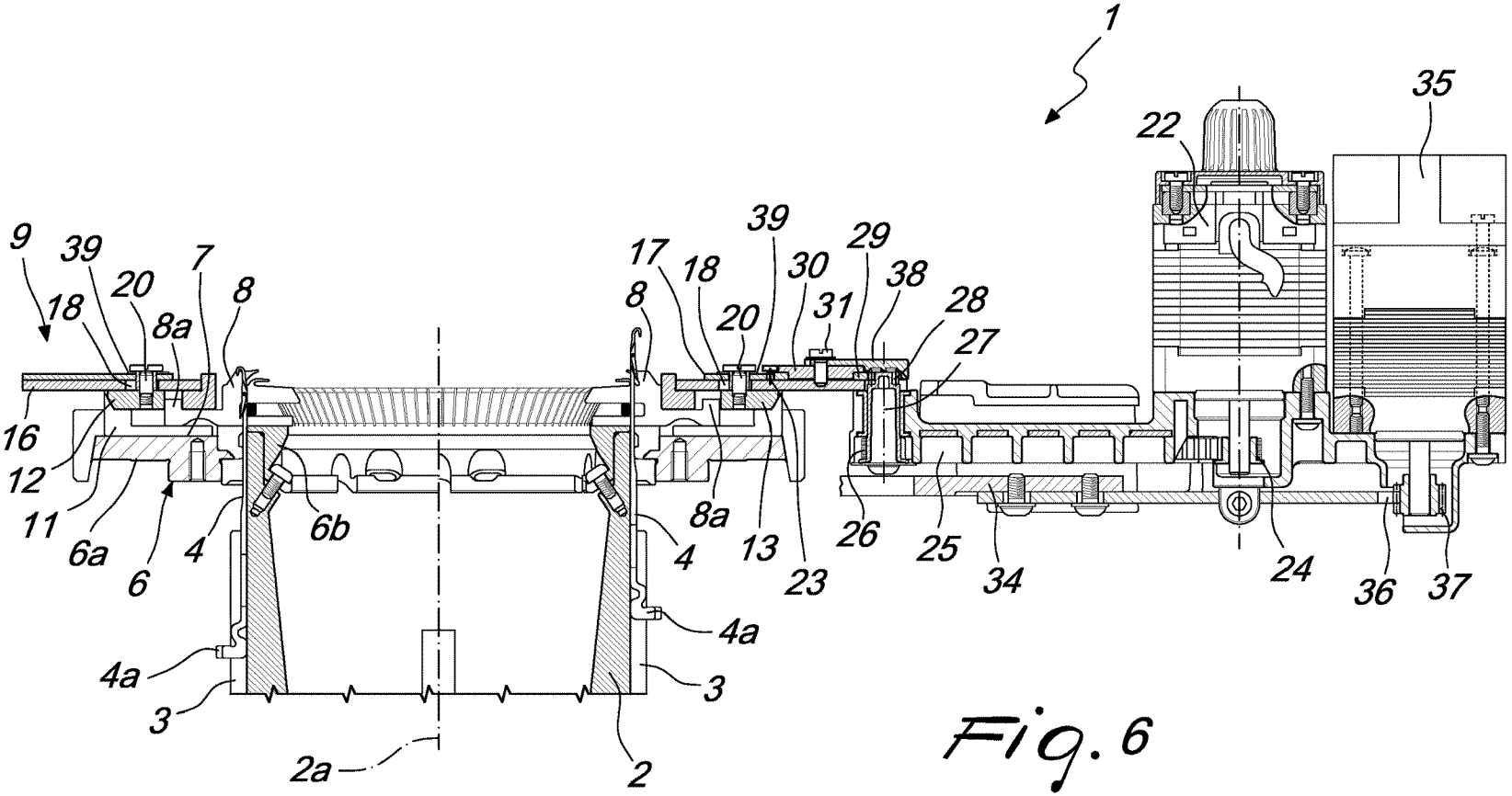
FIG. 6 is a sectional view of FIG. 5, taken along the line VI-VI.

During the formation of the first row of knitting, the needle cylinder 2 is actuated with a rotary motion about its own axis 2*a* with respect to the needle actuation cams 41 and with respect to the sinker actuation cams 10 along the direction of rotation 61. The heels 4*a* of the needles 4 excluded from knitting at the feed 5 being considered, pass above the cam 47, while the heels 4*a* of the needles 4 that are moved to knit at the feed 5, after picking up the yarn or yarns, are lowered by the central cam 44 and therefore by the knockover cam 42. When the heel 4*a* of the first needle 4 that has been moved to knit at the feed 5 engages the cam for lifting to the tuck or dropped position 45, the actuation element 17, by means of the actuation of the first electric motor 22, is moved to the second position so that the pins 20 of the first pusher cam 12 engage the second portion 19*b* of the contoured slots 19 and therefore the first pusher cam 12 is moved radially toward the axis 2*a* of the needle cylinder 2, passing from the inactive position to the pusher position, while the pins 20 of the second pusher cam 13 remain in the first portion 19*a* of the contoured slots 19, keeping the second pusher cam 13 in the inactive position (FIGS. 5 and 6). In this manner, the transition of the first pusher cam 12 to the pusher position is produced while the second pusher cam 13 is retained in the inactive position (FIG. 1). Due to this actuation, the heels 8*a* of the sinkers 8 that are contiguous to the needles 4 moved to knit at the feed 5 engage the first pusher cam 12, which, being in the pusher position, pushes the sinkers 8 to act on the freshly formed loops of knitting, tensioning them against the needles 4, while the sinkers 8 that are contiguous to the needles 4 that have been excluded from knitting at the feed 5 apply to the loops of knitting retained on the needles 4 a lower tension or no tension, since they engage the first pusher cam 12 when it is still in the inactive position.

Figure 7:
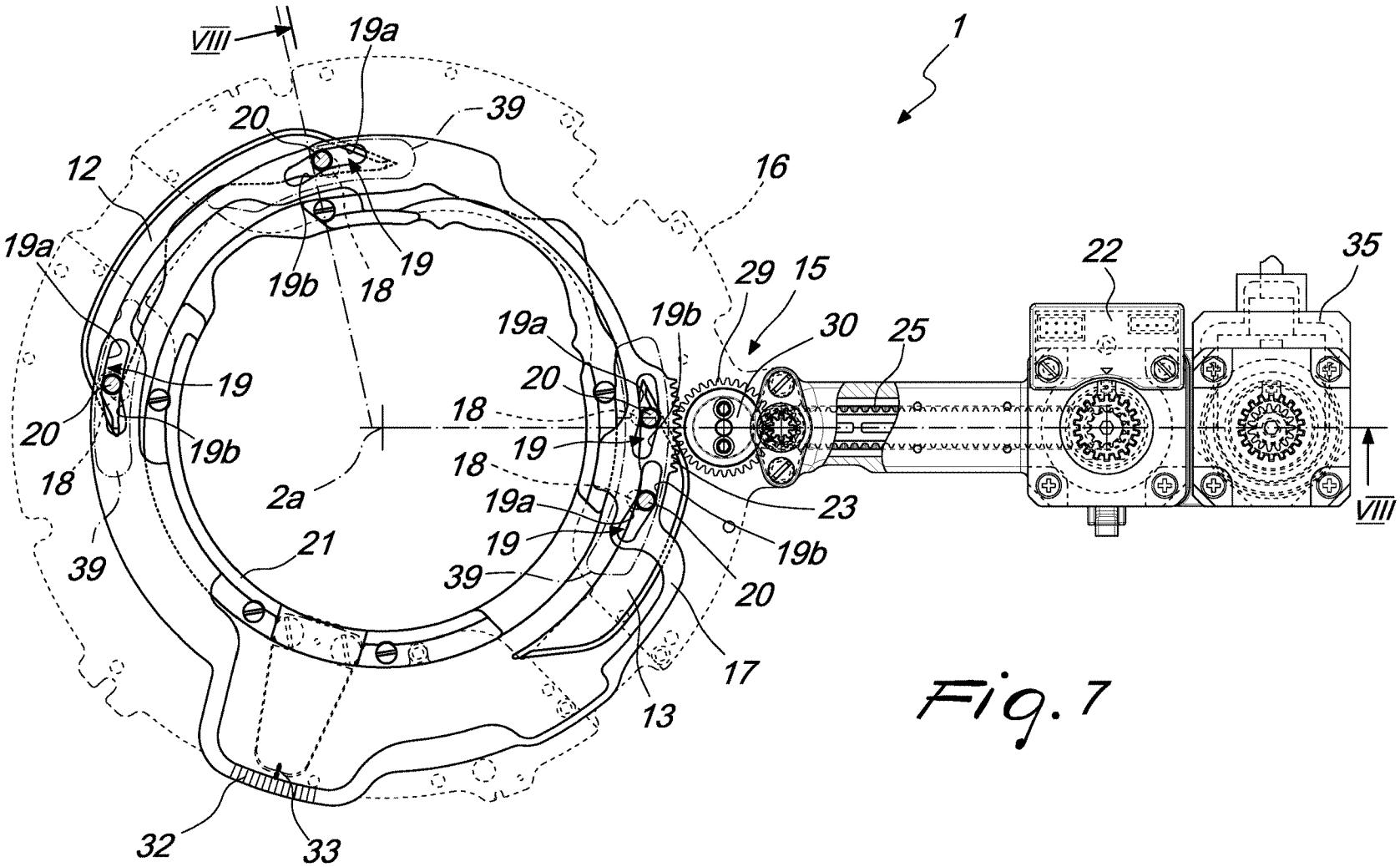
FIG. 7 is a schematic top plan view of a part of the sinker cap, with some elements shown in phantom lines, in another step of the operation of the machine.
Figure 8:
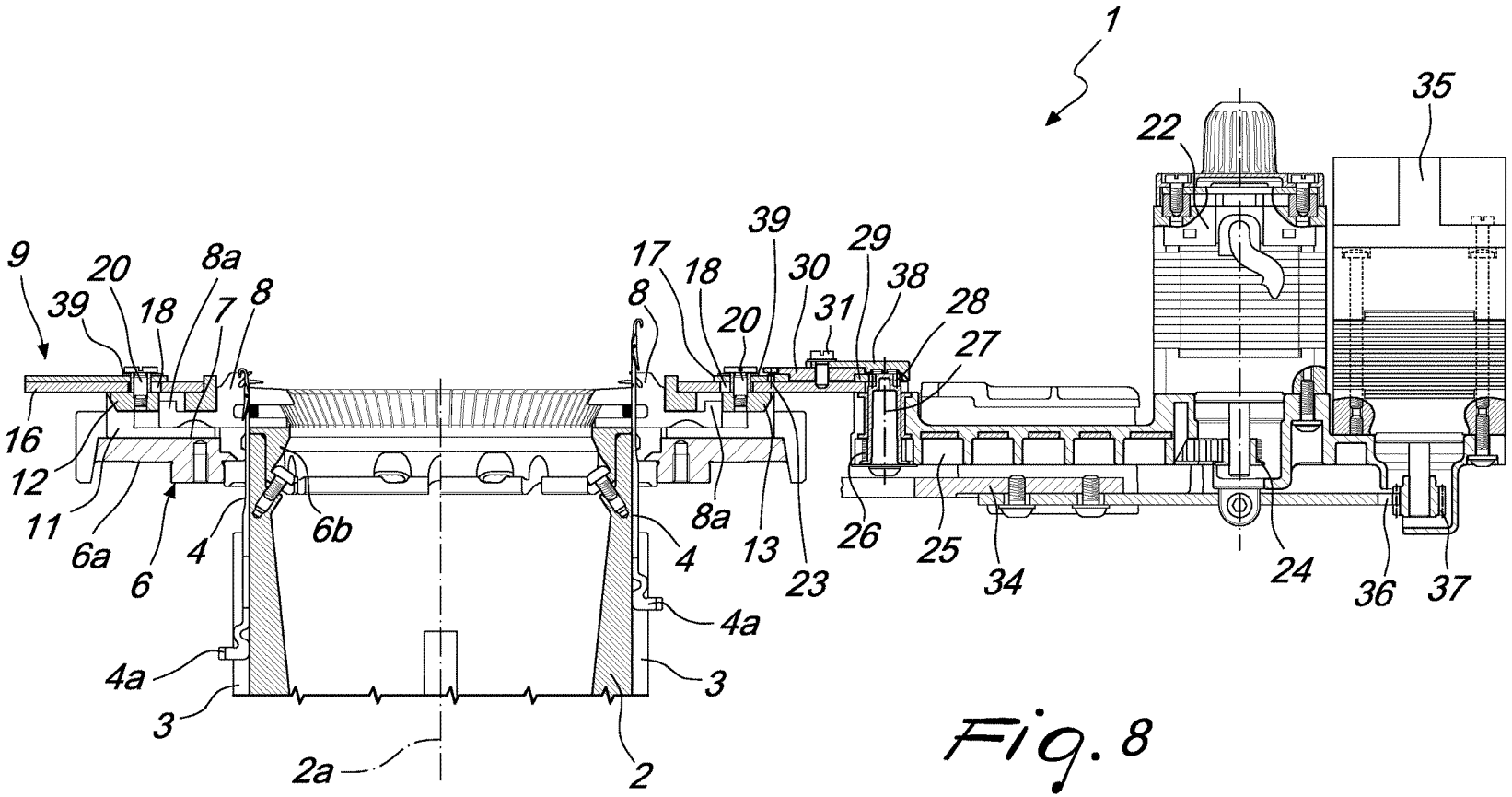
FIG. 8 is a sectional view of FIG. 7, taken along the line VIII-VIII.

When the heel 4*a* of the last needle 4 among the ones moved to knit at the feed 5 engages the cam for lifting to the tuck or dropped position 45, the actuation element 17 is moved, by means of the actuation of the first electric motor 22, to the intermediate position (FIGS. 2, 7 and 8). In this manner the pusher cams 12, 13 are both moved to the inactive position and therefore the tension applied by the sinkers 8 to the knitting arranged on the needles 4 that are excluded from knitting is reduced or nil.

Figure 9:
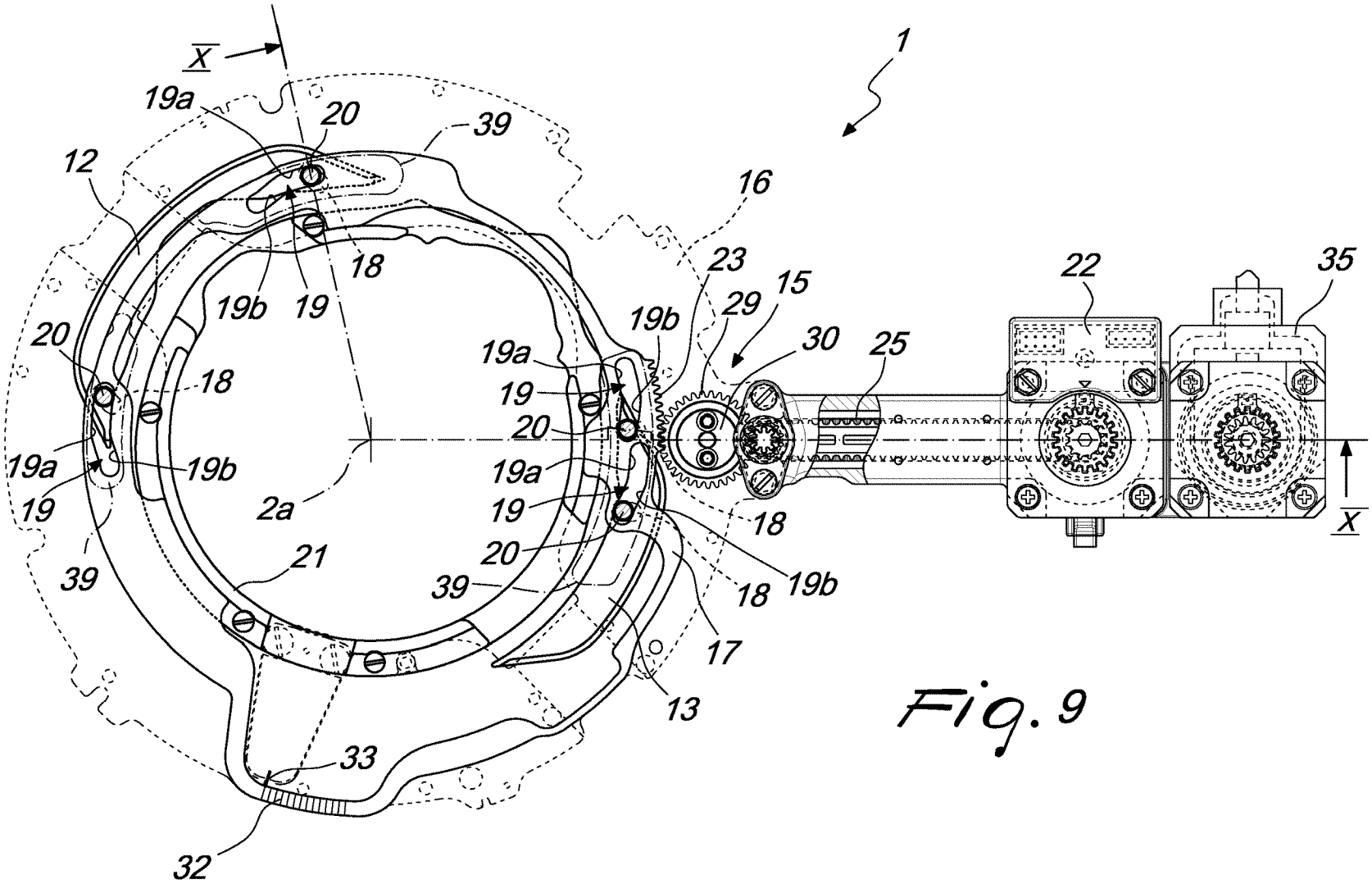
FIG. 9 is a schematic top plan view of a part of the sinker cap, with some elements shown in phantom lines, in a further step of the operation of the machine.
Figure 10:
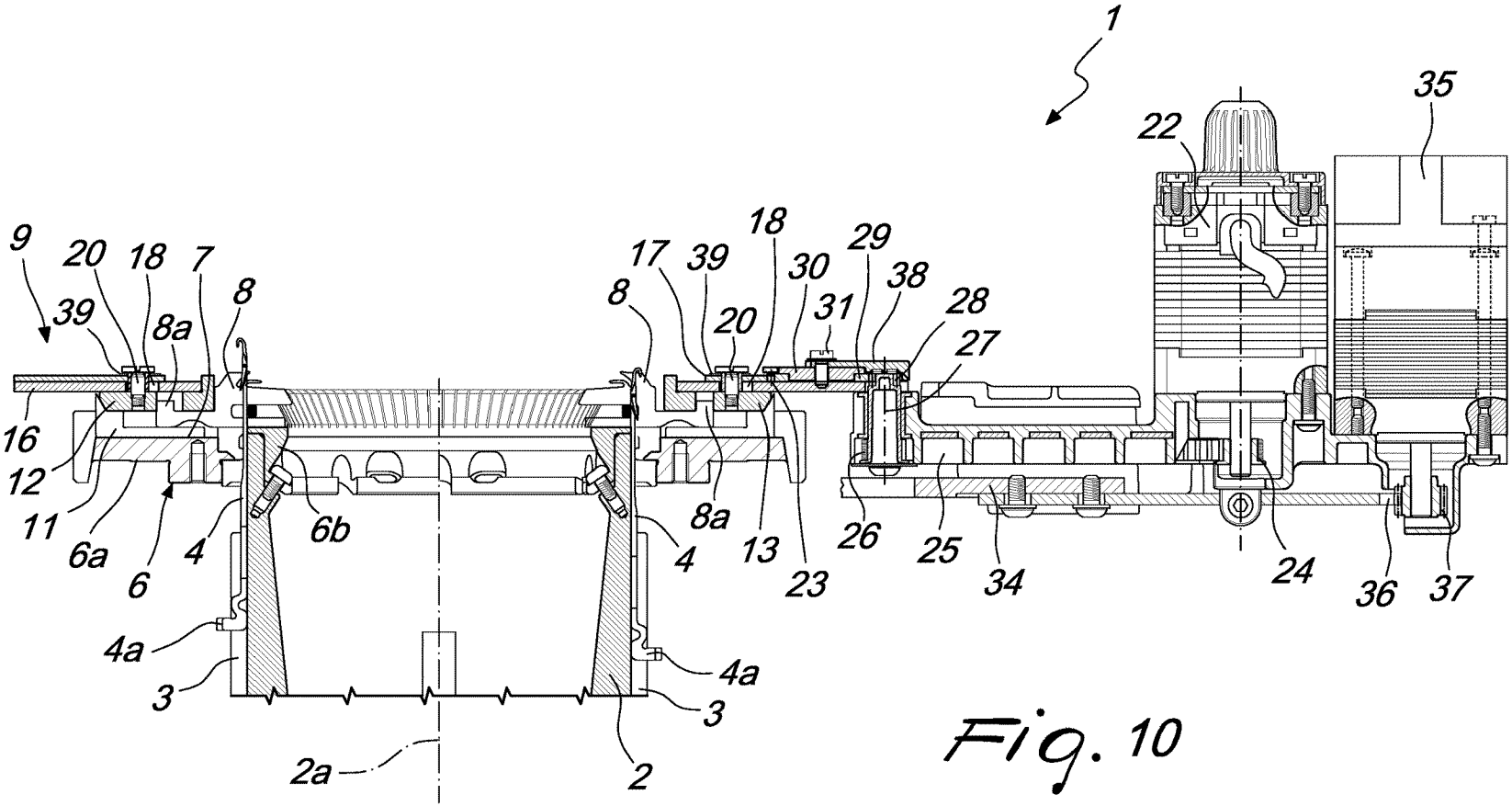
FIG. 10 is a sectional view of FIG. 9, taken along the line X-X.

When the direction of rotation of the needle cylinder 2 about its own axis 2*a* with respect to the needle actuation cams and the sinker actuation cams 10 is reversed, as shown in FIGS. 3, in which the direction of rotation of the needle cylinder 2 with respect to the needle actuation cams and the sinker actuation cams 10 is indicated by the arrow 62, the heels 4*a* of the needles 4 excluded from knitting at the feed being considered, pass above the cam 48, while the heels 4*a* of the needles 4 that are moved to knit at the feed 5, after picking up the yarn or yarns, are lowered by the central cam 44 and therefore by the knockover cam 43. When the heel 4*a* of the first needle 4 that has been moved to knit at the feed 5 engages the cam for lifting to the tuck or dropped position 46, the actuation element 17, by means of a new actuation of the first electric motor 22, is moved to the first position so that the pins 20 of the first pusher cam 12 remain in the first portion 19*a* of the contoured slots 19 and therefore the first pusher cam 12 is kept in the inactive position, while the pins 20 of the second pusher cam 13 engage the second portion 19*b* of the contoured slots 19 and therefore the second pusher cam 13 is pushed radially toward the axis 2*a* of the needle cylinder 2, passing from the inactive position to the pusher position (FIGS. 3, 9 and 10). Due to this actuation, the heels 8*a* of the sinkers 8 that are contiguous to the needles 4 that have been moved to knit at the feed 5 engage the second pusher cam 13, which, being in the pusher position, pushes the sinkers 8 to act on the freshly formed loops of knitting, tensioning them against the needles 4, while the sinkers 8 that are contiguous to the needles 4 excluded from knitting at the feed 5 apply to the loops of knitting retained on said needles 4 a lower tension or no tension, since they engage the second pusher cam 13 when it is still in the inactive position.

When the heel 4*a* of the last needle 4 among the ones moved to knit at the feed 5 engages the lifting cam in the tuck or dropped position 46, the actuation element 17 is moved, by means of the actuation of the first electric motor 22, to the intermediate position (FIG. 4). In this manner, the pusher cams 12, 13 are both moved to the inactive position and therefore the tension applied by the sinkers 8 to the knitting arranged on the needles 4 excluded from knitting is low or nil.

In practice it has been found that the machine according to the invention achieves fully the intended aim, since thanks to the alternating movement of the pusher cams it allows to reduce or eliminate the tensioning of the knitting at the needles that are not moved to knit at a feed or drop of the machine and to increase the tension of the knitting at the needles that are moved to knit at the feed being considered. This avoids an excessive tension of the knitting at the needles excluded from knitting at a feed or drop of the machine and therefore knitting errors are avoided, to the full advantage of production quality.

It should be noted that the alternating movement of the pusher cams allows to use a single electric motor, with a minimal increase in complexity of the production and assembly of the sinker cap and achieving high precision and reliability in operation in any operating condition.

In the machine according to the invention, the needles excluded from knitting during the alternating motion of the needle cylinder about its own axis may be raised with their tip above the sinkers or lowered with their tip below the knockover plane of the sinkers.

The machine thus conceived is susceptible of numerous modifications and variations, all of which are within the scope of the appended claims; all the details may further be replaced with other technically equivalent elements.

In practice, the materials used, as well as the dimensions, may be any according to the requirements and the state of the art.

The disclosures in Italian Patent Application No. MI2014A001852 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A circular machine for knitting hosiery, with sinker actuation device, comprising:

a needle cylinder, arranged so that an axis thereof is substantially vertical and actuatable with a rotary motion about said axis in both directions of rotation; said needle cylinder having, on its lateral surface, a plurality of axial grooves, each of which accommodates a needle that can move on command along the corresponding axial groove in order to pick up at least one yarn dispensed at at least one feed or drop and form knitting;

needle actuation cams, which face a lateral surface of the needle cylinder and define paths that are extended around the axis of the needle cylinder and can be engaged by at least one heel of the needles, which protrudes from the lateral surface of the needle cylinder, in order to actuate the movement of the needles along the corresponding axial groove with respect to the needle cylinder as a consequence of the rotation of the needle cylinder about its own axis with respect to said needle actuation cams and said at least one feed;

a sinker ring, which is integral with said needle cylinder in rotation about its own axis and is arranged coaxially to the needle cylinder at its upper end, said sinker ring supporting a plurality of sinkers that can move radially with respect to the needle cylinder and to the sinker ring;

a sinker cap, which is arranged above and coaxially with respect to said sinker ring and supports sinker actuation cams that define at least one path that is extended around the axis of the needle cylinder and can be engaged by a heel of the sinkers, which protrudes upwardly from said sinker ring, in order to actuate the movement of the sinkers along a radial direction with respect to the needle cylinder and to said sinker ring as a consequence of the rotation of the needle cylinder about its own axis with respect to said sinker cap, to said at least one feed and to said sinker actuation cams;

said needle actuation cams comprising two needle lifting cams, respectively a first cam for lifting the needles to the tuck or dropped position and a second cam for lifting the needles to the tuck or dropped position, which are arranged on mutually opposite sides with respect to an imaginary plane that passes through the axis of the needle cylinder and through said at least one feed or drop of the machine;

said sinker actuation cams comprising two pusher cams, respectively a first pusher cam and a second pusher cam, arranged on mutually opposite sides with respect to an imaginary plane that passes through the axis of the needle cylinder and through said at least one feed or drop of the machine; said pusher cams being able to engage said heel of the sinkers to cause the movement of said sinkers toward the axis of the needle cylinder;

wherein said first pusher cam and said second pusher cam are arranged respectively at said first cam for lifting the needles to the tuck or dropped position and at said second cam for lifting the needles to the tuck or dropped position and can move with respect to the sinker cap toward or away from the axis of the needle cylinder, actuation means being provided which act on said first pusher cam and on said second pusher cam in order to move alternatively said first pusher cam or said second pusher cam toward the axis of the needle cylinder or away from the axis of the needle cylinder.

2. The machine according to claim 1, wherein said first pusher cam and said second pusher cam can move on command with respect to said sinker cap from an inactive position, in which they are arranged at a preset distance from the axis of the needle cylinder, to a pusher position, in which they are arranged at a shorter distance from the axis of the needle cylinder with respect to said inactive position, and vice versa.

3. The machine according to claim 1, wherein said sinker cap comprises an annular cam supporting plate, which supports, so that they can slide along a direction with a radial component with respect to the axis of the needle cylinder, said first pusher cam and said second pusher cam; said actuation means comprising an actuation element that acts alternately on said first pusher cam and on said second pusher cam for their movement from said inactive position to said pusher position or vice versa.

4. The machine according to claim 3, wherein said pusher cams are arranged below said annular cam supporting plate and are provided with pins that pass through radial slots that are defined in said annular cam supporting plate and are elongated along directions with radial components with respect to the axis of the needle cylinder; said actuation element being arranged above said annular cam supporting plate and being extended around the axis of said needle cylinder; said actuation element having contoured slots provided with at least one first portion, which is extended substantially concentrically to the axis of the needle cylinder, and at least one second portion, which is extended progressively toward the axis of the needle cylinder starting from said first portion; said contoured slots being each engaged by one of the pins that are integral with said pusher cams; said actuation element being rotatable on command with respect to said first annular cam supporting plate about the axis of the needle cylinder from a first position, in which the pins of said first pusher cam are arranged along said first portion of the contoured slots while the pins of said second pusher cam are arranged along said second portion of the contoured slots, to a second position, in which the pins of said first pusher cam are arranged along said second portion of the contoured slots while the pins of said second pusher cam are arranged along said first portion of the contoured slots and vice versa.

5. The machine according to claim 4, wherein said actuation element can be arranged in an intermediate position between said first position and said second position, in which the pins of the pusher cams are arranged in the passage region between said first portion and said second portion of the contoured slots.

6. The machine according to claim 3, wherein said actuation means comprise a first electric motor that is connected kinematically, with its output shaft, to a toothed arch that is concentric to the axis of the needle cylinder and is defined in a peripheral region of said actuation element; said first electric motor being actuatable for the rotation of said actuation element about the axis of the needle cylinder with respect to said annular cam supporting plate from said first position to said second position or to said intermediate position and vice versa.

7. The machine according to claim 6, wherein said first electric motor is associated by means of its body with said annular cam supporting plate.

8. The machine according to claim 6, wherein said first electric motor is constituted by a step motor.

9. The machine according to claim 6, wherein said annular cam supporting plate is supported, so that it can rotate about the axis of the needle cylinder, by a supporting element, which is integral with the supporting structure of the machine, said annular cam supporting plate being able to rotate on command about the axis of the needle cylinder with respect to said supporting element through angles of preset breadth in order to anticipate or delay the intervention of said sinker actuation cams on the heels of said sinkers.

10. The machine according to claim 9, further comprising a second electric motor that is associated, by means of its body, with said annular cam supporting plate, said second electric motor being connected kinematically, by means of its output shaft, to a toothed arch that is concentric to the axis of the needle center and is defined in a peripheral region of said supporting element, said second electric motor being actuatable for the rotation, through angles of preset breadth, of said annular cam supporting plate about the axis of the needle cylinder with respect to said supporting element.

* * * * *